US007986201B2

(12) United States Patent
Jarno et al.

(10) Patent No.: US 7,986,201 B2
(45) Date of Patent: Jul. 26, 2011

(54) GUIDING DEVICES FOR ELECTROMAGNETIC WAVES AND PROCESS FOR MANUFACTURING THESE GUIDING DEVICES

(75) Inventors: Jean-François Jarno, Antony (FR); Christian Brylinski, Neuilly sur Seine (FR)

(73) Assignee: Thales (FR)

( * ) Notice: Subject to any disclaimer, the term of this patent is extended or adjusted under 35 U.S.C. 154(b) by 358 days.

(21) Appl. No.: 11/744,842

(22) Filed: May 5, 2007

(65) Prior Publication Data

US 2007/0257751 A1 Nov. 8, 2007

(30) Foreign Application Priority Data

May 5, 2006 (FR) ..... 06 04051

(51) Int. Cl.
*H01P 3/12* (2006.01)

(52) U.S. Cl. ..... 333/239; 333/248

(58) Field of Classification Search ..... 333/239; 436/2; 385/70; 136/249
See application file for complete search history.

(56) References Cited

U.S. PATENT DOCUMENTS 3,558,959 A * 1/1971 Ziemendorf ..... 313/130
5,503,685 A * 4/1996 Goldstein ..... 136/253
5,857,045 A * 1/1999 Lee ..... 385/70
5,861,782 A * 1/1999 Saitoh ..... 333/239
5,929,728 A * 7/1999 Barnett et al. ..... 333/239
6,052,044 A * 4/2000 Aves ..... 333/239
6,239,418 B1 * 5/2001 Konig et al. ..... 219/756
6,383,815 B1 * 5/2002 Potyrailo ..... 436/2
6,909,345 B1 * 6/2005 Salmela et al. ..... 333/239
6,927,653 B2 * 8/2005 Uchimura et al. ..... 333/208
7,064,263 B2 * 6/2006 Sano et al. ..... 136/249
7,414,366 B2 * 8/2008 Perez et al. ..... 313/621
2005/0175938 A1 8/2005 Casper et al.

FOREIGN PATENT DOCUMENTS

JP 60 160204 A 8/1985
WO 01/29924 A 4/2001

OTHER PUBLICATIONS

Andrew Ward, Elisabeth Weidmann: "Comprendre les céramiques" Structure: Revue De Matérialgraphie, vol. 31, 1997, pp. 10-13, XP002412482 Compenhague.

* cited by examiner

*Primary Examiner* — Rexford N Barnie
*Assistant Examiner* — Crystal L Hammond
(74) *Attorney, Agent, or Firm* — Lowe Hauptman Ham & Berner, LLP

(57) ABSTRACT

The invention relates to electromagnetic wave guiding devices or waveguides (f<10 THz) and to processes for manufacturing these waveguides, which comprise at least one body (30) supporting at least one active wall (40). The body (30) of the waveguide is made from a volume of a ceramic selected from the following: silicon carbides, aluminum nitride, boron nitrides, and especially 3C cubic and 2H hexagonal varieties of boron nitride, diamond, beryllium oxide or assemblies of said materials. Applications: waveguides, filter cavities, reflectors and antennas for radiofrequency waves and microwaves, atomic clocks and particle accelerators.

11 Claims, 2 Drawing Sheets

- Prior Art -

- Prior Art -

GUIDING DEVICES FOR ELECTROMAGNETIC WAVES AND PROCESS FOR MANUFACTURING THESE GUIDING DEVICES

RELATED APPLICATIONS

The present application is based on, and claims priority from, France Application No. 06 04051, filed May 5, 2006, the disclosure of which is hereby incorporated by reference herein in its entirety.

FIELD OF THE INVENTION

The invention relates to guiding devices for electromagnetic waves with a frequency of less than 10 terahertz.

BACKGROUND OF THE INVENTION

The term "guiding device" is understood to mean any device intended to control the propagation of electromagnetic waves. These devices cover in particular: waveguides, electromagnetic cavities, reflectors, diffusers, antennas, filters and attenuators.

Some of these guiding devices are used not only to control the propagation of electromagnetic waves, but they may also employ electron beams or beams of other particles that may or may not be provided with an electric charge. This is the case in particular for all electron tubes and nearly all particle accelerators.

In the rest of this text, for more succinct expression, and to differ from the usually accepted meaning of the term "waveguide", we will simply call any guiding device within the meaning defined above a "waveguide".

One particular example of a waveguide within our intended meaning is that of cavities for high-precision atomic clocks. In this example, the cavity consists of a single body, of complex shape, which includes several holes.

FIGS. 1*a* and 1*b* show one particular example of a cavity employed for producing an atomic clock. A microwave is introduced via an access port 4. This microwave interacts with a cesium beam ($J_c$) that passes through the cavity and is introduced via an aperture 6.

In all waveguides, the waves are confined by the positioning, in space, of physical objects called "bodies". Like any physical object, a body occupies a volume that is bounded by one or more closed surfaces. The vicinity of such a closed surface is called the "wall" of the body.

The particular feature of the body of a waveguide is that at least part of the surface of its walls interacts directly with the guided or confined electromagnetic waves and consequently must be endowed with controlled electromagnetic properties.

That part of a wall which interacts directly with the guided or confined electromagnetic waves, and which must be endowed with controlled electromagnetic properties, is called the "active" part of the wall. In the rest of the description, the term "active wall" will refer to an "active" part of a wall of a waveguide body.

It is the geometric and electromagnetic properties of the active walls that determine the electromagnetic properties of the waveguide.

Two types of characteristics of these active walls directly determine the electromagnetic behavior of the waveguide:

(1) their geometric shape; and (2) their reflectivity with respect to electromagnetic waves.

In the most demanding applications, the aim is to achieve very precise control of the electromagnetic wave propagation, which means that the geometric shape of the active walls of the waveguide must be controlled very precisely.

Depending on the application, the aim is to have different reflectivities on the active walls.

For example, for an attenuator, the aim is to absorb the waves in the active wall.

However, for most applications, in particular for a waveguide in the usual meaning of the term, for an electromagnetic cavity or for a reflector, the aim is usually for the active wall to be as reflective as possible with respect to the waves, without absorbing the energy of the wave. This means that the electrical conductivity of the body near the wall must be as high as possible at the frequencies corresponding to the waves present in the waveguide in operation.

More precisely, for these types of waveguide, which will be called "low-absorption" waveguides, it is necessary to ensure that the conducting material constituting the active wall, in direct contact with the electromagnetic waves, has the optimum electrical conductivity over a thickness equal to a few "skin depths" of the most penetrating components (with respect to the walls) of the wave that should reside in or travel through the waveguide.

For example, for a waveguide intended to be used at ambient temperature and at frequencies close to 10 GHz, the walls of the waveguide being made of copper, the skin depth is a fraction of one micron and it is sufficient for there to be less than 10 microns of copper on the wall in order to approach to better than 99% the quality factor of a cavity made of solid copper.

In specific waveguide applications, the main functionality of controlling the electromagnetic wave propagation is not the only one involved in the specification and design of the waveguide. Many other contingencies must also be considered.

The most common additional criteria relate to the following points:

- the volume and total mass of the waveguide;
- its resistance to mechanical attack, particularly accelerations, vibrations, impacts and stresses;
- its resistance to thermal attack, particularly temperature rises during heat treatments and temperature cycling during operation;
- its resistance to chemical attack, particularly to corrosive atmospheres;
- the electrical conductivity of the volume or certain regions of the inactive walls of the bodies;
- the manufacturability and manufacturing cost of the waveguide;
- its functional endurance in the intended application environment; and
- its ability to discharge the dissipated heat, very often essentially in the active walls.

DESCRIPTION OF THE PRIOR ART

One usual solution for producing a waveguide lies in the use of homogeneous metal bodies of high electrical conductivity.

Waveguides for radiofrequency waves or microwaves often use either a molded solid or recessed metal body, or a body consisting of a metal foil, the internal face of which defines the "activated wall" or "hot wall" of the cavity.

The most conventional solution consists in producing the body or bodies in a homogeneous metal of high electrical conductivity, such as copper, silver, gold or aluminum, and even in some cases to make use of superconducting materials.

There are two main drawbacks with this solution:

if the metal is a solid metal, the body is heavy;

if the metal is thin, the body is easily deformable since metals having a high electrical conductivity are, without exception, particularly soft. It is therefore necessary to fit a special device for controlling the change in geometry of the active walls under the operating conditions of the waveguide.

Other drawbacks are the fact that gold and silver are very expensive, while aluminum easily oxidizes.

All these metals are easily deformable. This may pose problems if the waveguide is subjected to large accelerations or mechanical stress, for example during the take-off or landing of an aircraft, or rocket in the case of a waveguide intended to be used in a satellite. Very strong bodies must be made so that the active walls deform as little as possible. Metals having a high electrical conductivity also have, almost in all cases, a high thermal expansion coefficient, which effect may distort the shape of the waveguide volume in the operational environment in which the waveguide is used, if the waveguide is exposed to an inhomogeneous heat flux. As mentioned above, this distortion may be detrimental.

This solution also has additional drawbacks:

since the volume of the body is electrically conducting, if it is subjected to a temperature gradient, permanent thermoelectric currents may be generated that may induce magnetic fields, these fields possibly disturbing the motion of charged particles in the waveguide.

However, these metals are all good thermal conductors.

As regards superconducting materials, these need to be permanently cooled in order to operate, which cooling requires a bulky, expensive and complex infrastructure.

In the example of the cavity for an atomic clock, shown in FIG. 1*a*, when this type of cavity is made conventionally, the single body is made of solid copper.

For reasons of convenience, the body of the cavity in FIG. 1*a* is manufactured by assembling two half-bodies 10, 12. The two half-bodies are assembled in a known manner using a thermal or mechanical effect.

FIG. 1*b* shows one of the two half-bodies 12 of the cavity of FIG. 1*a*.

The conventional process for producing the cavity of FIG. 1*a* includes, in particular, steps for manufacturing two half-bodies 10, 12, made of a copper alloy, which are symmetrical with respect to an assembly plane P, each half-body having a half-recess 16, 18. Joining the two half-bodies together forms the recess 20, the boundary of which is the "active wall" of the cavity, in direct contact with the electromagnetic waves.

A second standard solution consists in using a body most of the volume of which is made in a first material, which body includes a layer of a second material, having a high electrical conductivity, which is attached to or deposited on all or part of the surface of the body or bodies, on the active wall or active walls of the waveguide.

An advantageous variant of this second approach for producing a body consists in using, as first material for producing the volume of a body, a metal, insulator or semiconductor material having favorable thermomechanical properties, superior to those of bulk metals, with respect to the additional quality criteria mentioned above. In this case, a layer of a second material, that having a high electrical conductivity, may be attached to or deposited on the active walls of the cavity.

The thickness of this layer of the second material must be at least equal to a few "skin depths" of the most penetrating components (with respect to the walls) of the waves that should reside in or travel through the waveguide.

This second solution may allow some of the problems to be solved by a judicious choice of the first material used to produce a body. This may in particular be:

either a metal or semiconductor or insulator material which has a lower density than metals that are good electrical conductors;

or a metal or semiconductor or insulator material which has a lower expansion coefficient than metals that are good electrical conductors;

or a metal or semiconductor or insulator material which has a lower thermoelectric coefficient than metals that are good electrical conductors;

or a metal or semiconductor or insulator material which has a higher mechanical strength than metals that are good electrical conductors.

The ideal would be to find a material that combines all these properties.

To find a metal that meets all these conditions seems very difficult, if not impossible, especially if, as is often the case, additional properties are also required of the metal.

Moreover, the insulator materials that could be selected for producing such a cavity body are often very hard materials which are difficult to form.

SUMMARY OF THE INVENTION

To alleviate the drawbacks of the waveguides of the prior art, the invention proposes a novel type of electromagnetic waveguide comprising at least one body supporting at least one active wall of predetermined geometric shape, wherein the body or bodies of the waveguide, or the parts assembled to form the body or bodies of the waveguide, are produced from a volume of a ceramic selected from the following : silicon carbide, aluminum nitride, boron nitride, and especially 3C cubic and 2H hexagonal varieties of boron nitride, diamond, beryllium oxide, solid solutions of said materials or assemblies thereof.

The ceramics of the body according to the invention exhibit a high thermal conductivity and, for the most part, a low electrical conductivity.

For some applications, there are advantages in using for the body a ceramic that is electrically insulating or semi-insulating.

These ceramics for the bodies of the cavity may be employed in various forms:

single crystals;

polycrystals, textured to a greater or lesser extent;

formed composites, the matrix of which differs in nature from that of the aggregates that are embedded therein;

laminated materials; and assemblies of parts using known methods for assembling ceramics.

Compared to existing waveguides, with active walls of geometrically similar shape, the waveguides according to the invention offer improved thermomechanical characteristics for the same or similar electromagnetic characteristics.

Advantageously, a body of the waveguide according to the invention has, near the active wall(s) a coating (for example in layer form) made of an electrically conducting material. The electrically conducting material of the active wall(s) is made of a metal selected from the following: gold, silver, copper, aluminum.

In a preferred embodiment, the body has, near the active walls, one or more intermediate layers inserted between the coating of electrically conducting material and the ceramic volume. The function of the layer directly in contact with the ceramic can be to promote tying to the ceramic. In that case, such a layer is called a "tie layer". This single layer or another layer of the stack of intermediate layers may serve as a diffusion barrier and thus prevent any inopportune chemical reaction between the external metal coating and the ceramic of the body. This single layer, or else one, two or more other layers of the stack, may again be used to accommodate the difference in expansion coefficient between the material of the electrically conducting coating and the ceramic of the body.

The intermediate layer(s) may be made of a metal selected from the following metals: aluminum, titanium, zirconium, hafnium, vanadium, niobium, tantalum, chrome, molybdenum, tungsten, or produced in an alloy of these metals, or else a carbide, silicide, nitride or boride compound of one or more of these metals, a metal, semiconductor or insulator compound, or else a ternary, quaternary or multiple solid solution of such compounds.

In one family of particular embodiments of waveguides according to the invention, the coating layer made of electrically conducting material, on the active walls of the body or bodies of the waveguide, is made of copper and the ceramic is silicon carbide.

The advantages of this type of waveguide according to the invention are:

- low bulk density;
- very high mechanical strength;
- very low thermal expansion coefficient;
- good heat conduction;
- compatibility with ultrahigh vacuum;
- use of very high temperatures for producing or operating said waveguide, without impairing its performance; and
- in certain cases, the electrical insulation properties of the cavity body are advantageously used for functions other than those that use "active walls" of the cavity.

One of the main applications of this invention is the production of microwave waveguides, particularly electromagnetic cavities, reflectors and antennas, of low weight and very high mechanical strength.

Other advantages associated with the waveguides according to the invention lie in the fact that their bodies have a very low thermal expansion coefficient and good heat conduction. Furthermore, the bodies of certain waveguides according to the invention may exhibit good compatibility with ultrahigh vacuum and allow the use of very high temperatures for producing or operating them, without impairing their performance.

The invention also relates to a process for manufacturing an electromagnetic waveguide comprising at least one body supporting at least one active wall of predetermined geometric shape, which process comprises at least the following steps:

- production of at least one body of the waveguide from a volume of a ceramic selected from the following : silicon carbide, aluminum nitride, boron nitride, and especially 3C cubic and 2H hexagonal varieties of boron nitride, diamond, beryllium oxide, solid solutions of said materials or assemblies thereof;
- possible deposition of one or more intermediate layers on all or parts of the active walls of the body; and
- deposition of a metal coating having a high electrical conductivity, either directly on the ceramic or on the intermediate layers, at least over the entire surface of the active walls of the body or bodies.

In a process for manufacturing a waveguide according to the invention, at least one of the bodies of the waveguide is obtained by assembling two half-bodies.

BRIEF DESCRIPTION OF THE DRAWINGS

The invention will be better understood from the description of a first exemplary embodiment of a waveguide according to the invention with the aid of referenced drawings in which.

DESCRIPTION OF THE PREFERRED EMBODIMENTS

Figure 2B:
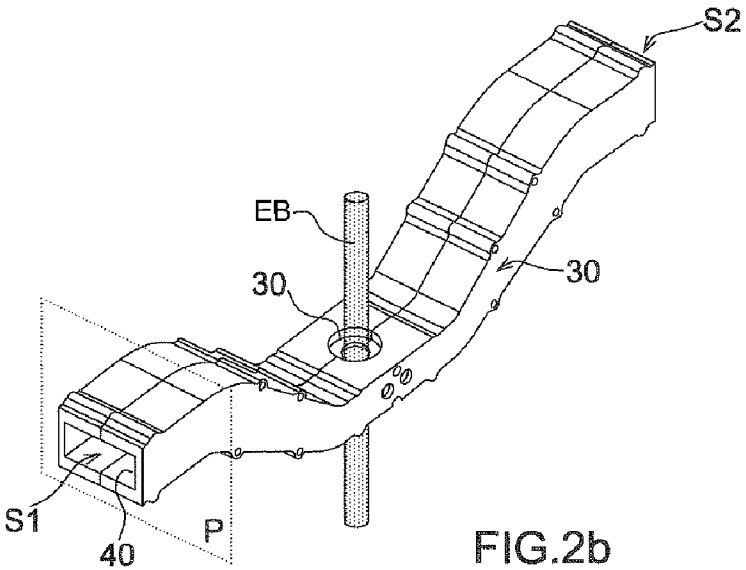
FIGS. 2*a* and 2*b* show the steps of a process for manufacturing a body of a waveguide according to the invention.
Figure 2A:
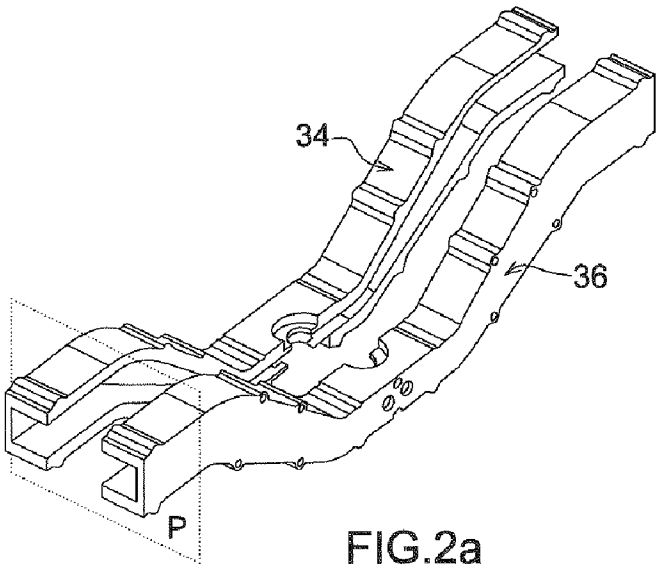

A body 30 of a waveguide according to the invention, shown in FIGS. 2*a* and 2*b*, includes two microwave ports S1 and S2 and apertures 32 in the waveguide walls intended for passage of an electron beam EB. More precisely, this is a waveguide in the usual meaning of the term, comprising two outputs S1 and S2 for the microwave signals produced, in the waveguide, by the passage of the electron beam EB through the waveguide, via the apertures 32 made in the body of the waveguide.

In this embodiment, the body 30 of the cavity is obtained by assembling two half-bodies 34, 36 (see FIG. 2*a*).

Figure 2E:
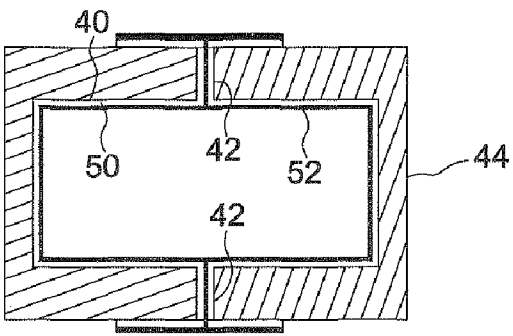
FIG. 2*e* shows a cross section of the body of FIGS. 2*a* and 2*b* before assembly.
Figure 2D:
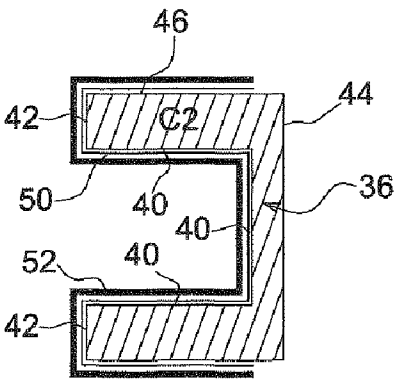
FIGS. 2*c* and 2*d* show sectional views in a plane P of the cross sections of the half-bodies of FIGS. 2*a* and 2*b* before assembly.
Figure 2C:
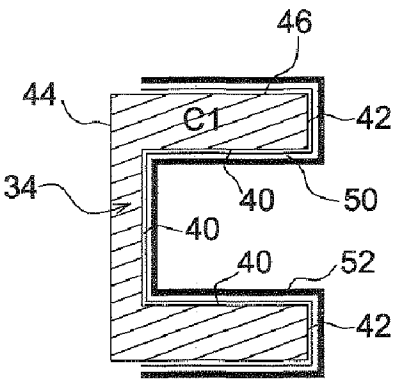

FIGS. 2*c* and 2*d* show sectional views in a plane P of the cross sections of the half-bodies of FIGS. 2*a* and 2*b* before assembly. FIG. 2*e* shows a cross section of the waveguide body 30 resulting from assembling the two half-bodies shown in FIGS. 2*c* and 2*d*.

The manufacturing process comprises the following main steps:

- production of the volume of the two half-bodies 34, 36 made of a silicon-carbide-based ceramic. In this particular embodiment, the sections C1 and C2 of each half-body 34, 36 are in the form of a half-tube with a rectangular cross section of the same shape, comprising an active wall 40, inactive walls 42, called closure walls of the waveguide, that are intended to be brought into contact with each other to assemble the body of the waveguide, and external walls 44 of the waveguide. Among these external walls may be distinguished adjacent walls 46 that join the closure walls 42;
- deposition of one or more intermediate layers 50 on the active walls 40, the closure walls 42 and the adjacent external walls 46 of the two half-bodies 34, 36 that join the closure walls 42; and
- deposition of a copper coating 52 on the intermediate layers, on the active walls 40, closure walls 42 and optionally also the adjacent walls 46.

The intermediate layers 50 are inserted between the copper coating 52 and the surfaces of the active walls 40, the closure walls 42 and possibly the adjacent external walls 46 of the ceramic body, on the one hand in order to obtain good adhesion of the metal coating to the surfaces of the walls of the body and, on the other hand, optionally, to act as a diffusion barrier and thus prevent any inopportune chemical reaction between the copper coating and the ceramic of the silicon-carbide-based body, and also, possibly for accommodating the difference in thermal expansion coefficient between the material of the electrically conducting coating 52 and the ceramic of the body 30.

The composition of the intermediate layers depends on the heat treatments that the body will have to undergo during assembly of the waveguide, or during the subsequent life of the waveguide. Depending on the manufacturing temperatures or operating temperatures of the cavity, it is possible to use either a single layer, or two or more layers. In the simplest cases, it is possible to use a single layer, of sufficient thickness, of a material that reacts neither with the copper nor with the ceramic.

The intermediate layer(s) 50 may be made of a metal selected from the following metals: aluminum, titanium, zirconium, hafnium, vanadium, niobium, tantalum, chrome, molybdenum, tungsten, or produced in an alloy of these metals, or else a carbide, silicide, nitride or boride compound of one or more of these metals, a metal, semiconductor or insulator compound, or else a ternary, quaternary or multiple solid solution of such compounds.

The copper coating 52 forms the metal coating on the active walls of the two half-bodies and is deposited at least over the entire surface of the active walls 40 of the waveguide and also over all or part of the surface of the closure walls 42 and possibly also over all or part of the surface of the adjacent walls 46.

For a copper coating thickness of a few microns, it is possible to obtain a level of absorption of microwaves in the X-band region (at a frequency of around 10 GHz) comparable to that of a solid copper waveguide, for the same geometry of the active walls; and assembly of the two half-bodies 34, 36 to form the waveguide body 30, by brazing, welding or thermocompression bonding, on the closure walls 42 of the copper-coated half-bodies using known copper-to-copper assembly methods.

The two half-bodies may also be assembled by any other assembly method that allows the parts to be held together in intimate contact.

In the embodiment of the waveguide shown in FIG. 2*b*, the ceramic volumes of the two half-bodies 34, 36 are obtained by sintering a small-grain silicon carbide powder to which, according to known techniques, sintering-promoting additives, often based on boron and/or silicon, are usually added.

Each half-body 34, 36 is formed cold, before sintering, and is then ground after sintering.

The manufacturing process described for producing the waveguide of FIG. 2*b* is of course applicable to waveguides (within the usual meaning of the term) or cavities for electron tubes, for example of the klystron type. In this case, the shapes of the half-bodies change according to the application.

Figure 1A:
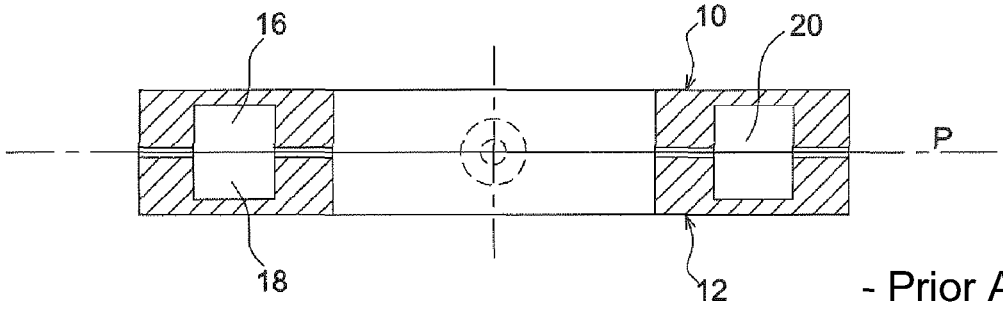
FIGS. 1*a* and 1*b*, already described, show one particular embodiment of a cavity of the prior art.

A second embodiment of a waveguide according to the invention is that of a variant of the cavity shown in FIG. 1*a*, already described above:

FIG. 1*a* shows a body of this cavity formed from two half-bodies; and

Figure 1B:
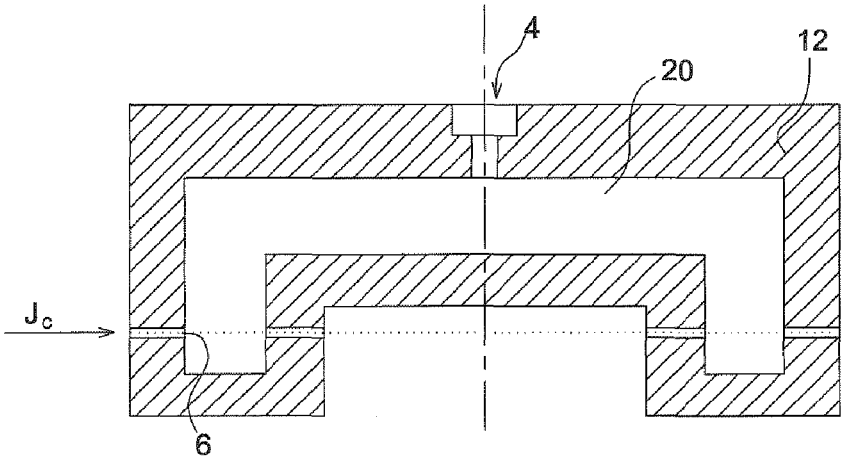

FIG. 1*b* shows one of the two half-bodies of the cavity of FIG. 1*a* before the two half-bodies are assembled.

Each half-body may be produced according to the invention using the specified materials according to the invention, that is to say one, two or more ceramic volumes covered with one or more layers according to the invention.

The body of the cavity may be assembled as in the case of the first embodiment described above.

The invention applies to many fields covering, in particular, the following applications of "waveguides" produced according to the principles described in the invention:

atomic clocks, for example cesium-beam or rubidium-beam atomic clocks;

microwave cavities and waveguides having metallic or superconducting "active walls";

electronic devices: amplifiers, switches, limiters, which employ electrons or other charged particles, in a vacuum or in a controlled gaseous atmosphere, or else within a plasma; and particle, particularly electron, proton or positron, accelerators, in which the particles may or may not have an electric charge or an electric or magnetic dipole or quadripole.

The invention claimed is:

1. A microwave waveguide, comprising:

at least one body supporting at least one active wall of predetermined geometric shape, the at least one body has, near the at least one active wall, a coating layer made of an electrically conducting material comprising a metal selected from gold, silver, copper, and aluminum, the at least one body, or the parts assembled to form the at least one body, are produced from a ceramic selected from the following: silicon carbide, aluminum nitride, boron nitride, and 3C cubic and 2H hexagonal varieties of boron nitride, diamond, beryllium oxide, solid solutions of said materials or assemblies thereof, the at least one body has, near the active wall, one or more intermediate layers inserted between the coating layer and the ceramic, the one or more intermediate layers having a first side and a second opposing side, the first side being in direct contact with the ceramic body and the second side being in direct contact with the coating layer;

the intermediate layer or layers are made of a metal selected from the following metals: aluminum, titanium, zirconium, hafnium, vanadium, niobium, tantalum, chrome, molybedenum, and tungsten, or are produced in an alloy of these metals, or a carbide, silicide, nitride or boride compound of one or more of the metals, a metal, semiconductor or insulator compound, or a ternary, quaternary or multiple solid solution of said compounds, wherein the intermediate layer or layers directly in contact with the ceramic body are configured to promote tying to the ceramic body; and wherein at least one of the intermediate layers is a diffusion barrier for preventing chemical reaction between the coating of electrically conducting material and the ceramic body.

2. The waveguide as claimed in claim 1, wherein the coating layer is made of copper and the ceramic is silicon carbide.

3. The waveguide as claimed in claim 2, wherein the materials forming the at least one ceramic body are employed in forms, including:

single crystals;

textured polycrystals;

formed composites, the matrix of which differs from aggregates that arc embedded therein; and laminated materials.

4. The waveguide as claimed in claim 1, wherein the materials making up the at least one body are formed as:

single crystals;

polycrystals, textured to a greater or lesser extent;

formed composites, the matrix of which differs in nature from that of the aggregates that are embedded therein; and laminated materials.

5. A process of manufacturing a microwave waveguide comprising at least one body supporting at least one active wall of predetermined geometric shape, the process comprises the following steps:

producing at least one body of the waveguide from a ceramic selected from: silicon carbide, aluminum nitride, boron nitride, and 3C cubic and 2H hexagonal varieties of boron nitride, diamond, beryllium oxide, solid solutions of said materials or assemblies thereof;

depositing one or more intermediate layers directly on the active walls of the ceramic body, wherein the one or more intermediate layers are made of a metal selected from the following metals: aluminum, titanium, zirconium, hafnium, vanadium, niobium, tantalum, chrome, molybdenum, tungsten or produced in an alloy of these metals, or a carbide, silicide, nitride or boride compound of one or more of the metals, a metal, semiconductor or insulator compound, or else a ternary, quaternary or multiple solid solution of such compounds; and depositing a metal coating having a high electrical conductivity, either directly on the ceramic body or on the one or more intermediate layers, over at least the entire surface of the active walls of the at least one ceramic body; and wherein at least one of the intermediate layers is a diffusion barrier for preventing chemical reaction between the coating of electrically conducting material and the ceramic body.

6. A process of manufacturing a waveguide wherein at least one body of the waveguide is made by assembling together a first and second half-body section, the process comprises at least the following steps:

producing a volume of the two half-body sections made of a silicon carbide ceramic, the two half-body sections having a rectangular half-tube form of a same shape, each half-body section comprising an active wall, closure walls configured to be brought into contact with the other half-body section to form the body and external walls of the waveguide and, among the external walls, adjacent walls that join the closure walls;

depositing one or more intermediate layers directly on the active walls, the closure walls, and the adjacent external walls that join the closure walls, wherein the one or more intermediate layers are made of a metal selected from the following metals: aluminum, titanium, zirconium, hafnium, vanadium, niobium, tantalum, chrome, molybdenum, tungsten, or an alloy of these metals, or a carbide silicide, nitride or boride compound of one or more of these metals, or a solid solution of two or more of these metals and compounds;

depositing a copper coating on the one or more intermediate layers on at least the active walls of the half-bodies; and assembling together the two half-bodies by brazing, welding or thermocompression bonding the closure walls of the copper-coated half-bodies; and wherein at least one of the intermediate layers is a diffusion barrier for preventing chemical reaction between the coating of electrically conducting material and the ceramic body.

7. The process of manufacturing a waveguide as claimed in claim 6, wherein the two ceramic half-bodies are formed by sintering a small-grain silicon carbide powder to which sintering-promoting additives based on boron and/or silicon are added.

8. The process for manufacturing a waveguide as claimed in claim 7, wherein each ceramic half-body is formed cold, before sintering, and is ground after sintering.

9. A microwave waveguide, comprising:

at least one body supporting at least one active wall of predetermined geometric shape, the at least one body has, near the at least one active wall, a coating layer made of an electrically conducting material comprising a metal selected from gold, silver, copper, and aluminum, the at least one body, or the parts assembled to form the at least one body, are produced from a ceramic selected from the following: silicon carbide, aluminum nitride, boron nitride, and 3C cubic and 2H hexagonal varieties of boron nitride, diamond, beryllium oxide, solid solutions of said materials or assemblies thereof, the at least one body has, near the active wall, one or more intermediate layers inserted between the coating layer and the ceramic, the one or more intermediate layers having a first side and a second opposing side, the first side being in direct contact with the ceramic body and the second side being in direct contact with the coating layer;

the intermediate layer or layers are made of a metal selected from the following metals: aluminum, titanium, zirconium, hafnium, vanadium, niobium, tantalum, chrome, molybedenum, and tungsten, or are produced in an alloy of these metals, or a carbide, silicide, nitride or boride compound of one or more of the metals, a metal, semiconductor or insulator compound, or a ternary, quaternary or multiple solid solution of said compounds, wherein the intermediate layer or layers directly in contact with the ceramic body are configured to promote tying to the ceramic body; and wherein at least one of the intermediate layers is configured to accommodate a difference in expansion coefficient between the coating of electrically conducting material and the ceramic body.

10. A process of manufacturing a microwave waveguide comprising at least one body supporting at least one active wall of predetermined geometric shape, the process comprises the following steps:

producing at least one body of the waveguide from a ceramic selected from: silicon carbide, aluminum nitride, boron nitride, and 3C cubic and 2H hexagonal varieties of boron nitride, diamond, beryllium oxide, solid solutions of said materials or assemblies thereof;

depositing one or more intermediate layers directly on the active walls of the ceramic body, wherein the one or more intermediate layers are made of a metal selected from the following metals: aluminum, titanium, zirconium, hafnium, vanadium, niobium, tantalum, chrome, molybdenum, tungsten or produced in an alloy of these metals, or a carbide, silicide, nitride or boride compound of one or more of the metals, a metal, semiconductor or insulator compound, or else a ternary, quaternary or multiple solid solution of such compounds; and depositing a metal coating having a high electrical conductivity, either directly on the ceramic body or on the one or more intermediate layers, over at least the entire surface of the active walls of the at least one ceramic body; and wherein at least one of the intermediate layers is configured to accommodate a difference in expansion coefficient between the coating of electrically conducting material and the ceramic body.

11. A process of manufacturing a waveguide wherein at least one body of the waveguide is made by assembling together a first and second half-body section, the process comprises at least the following steps:

producing a volume of the two half-body sections made of a silicon carbide ceramic, the two half-body sections having a rectangular half-tube form of a same shape, each half-body section comprising an active wall, closure walls configured to be brought into contact with the other half-body section to form the body and external walls of the waveguide and, among the external walls, adjacent walls that join the closure walls;

depositing one or more intermediate layers directly on the active walls, the closure walls, and the adjacent external walls that join the closure walls, wherein the one or more intermediate layers are made of a metal selected from the following metals: aluminum, titanium, zirconium, hafnium, vanadium, niobium, tantalum, chrome, molybdenum, tungsten, or an alloy of these metals, or a carbide silicide, nitride or boride compound of one or more of these metals, or a solid solution of two or more of these metals and compounds;

depositing a copper coating on the one or more intermediate layers on at least the active walls of the half-bodies; and assembling together the two half-bodies by brazing, welding or thermocompression bonding the closure walls of the copper-coated half-bodies;

wherein at least one of the intermediate layers is configured to accommodate a difference in expansion coefficient between the coating of electrically conducting material and the ceramic body.

* * * * *